United States Patent [19]

Ferguson

[11] Patent Number: 4,892,494

[45] Date of Patent: Jan. 9, 1990

[54] POWER STEERING MECHANISM FOR MARINE INSTALLATIONS

[75] Inventor: Arthur R. Ferguson, Northbrook, Ill.

[73] Assignee: Outboard Marine Corporation, Waukegan, Ill.

[21] Appl. No.: 177,530

[22] Filed: Apr. 4, 1988

Related U.S. Application Data

[63] Continuation-in-part of Ser. No. 28,958, Mar. 23, 1987, Pat. No. 4,744,777.

[51] Int. Cl.[4] ..... B63H 21/26

[52] U.S. Cl. ..... 440/61; 440/63; 180/162

[58] Field of Search ..... 144/144 R, 144 A, 150, 144/15 A, 157; 440/49, 53, 61, 63; 180/158, 159, 162, 163, 79, 132, 154; 91/216 R, 44 A; 74/388 R, 388 PS, 480 B, 484 R, 486, DIG. 8

[56] References Cited

U.S. PATENT DOCUMENTS

| | | | |
|---|---|---|---|
| 2,928,377 | 3/1960 | Ford | 121/41 |
| 2,929,362 | 3/1960 | Hayner | 121/41 |
| 3,373,642 | 3/1968 | Simpson | 83/76 |
| 3,590,690 | 7/1971 | Dalbera | 244/226 |
| 3,631,833 | 1/1972 | Shimanckas | 440/55 |
| 4,227,481 | 10/1980 | Cox et al. | 440/61 |
| 4,295,833 | 10/1981 | Borst | 440/63 |
| 4,373,920 | 2/1983 | Hall et al. | 440/59 |
| 4,414,084 | 12/1983 | Borst | 440/58 |
| 4,449,945 | 5/1984 | Ferguson | 440/53 |
| 4,568,292 | 2/1986 | Hall | 440/61 |
| 4,592,732 | 6/1986 | Ferguson | 440/61 |
| 4,595,370 | 6/1986 | Small | 440/53 |
| 4,615,290 | 10/1986 | Hall | 114/150 |
| 4,710,141 | 12/1987 | Ferguson | 440/61 |
| 4,744,777 | 5/1988 | Ferguson | 440/61 |

*Primary Examiner*—Joseph F. Peters, Jr.
*Assistant Examiner*—Clifford T. Bartz
*Attorney, Agent, or Firm*—Michael, Best & Friedrich

[57] ABSTRACT

A marine propulsion device comprising a mounting assembly adapted to be mounted on a boat and including a tilt tube extending along a generally horizontal tilt axis, a propulsion unit mounted on said mounting means for pivotal movement relative thereto about said tilt axis and about a generally vertical steering axis, said propulsion unit including a propeller shaft adapted to rotatably support a propeller, an elongated member slideably housed within said tilt tube for axial movement relative thereto, an extendible and contractible hydraulic assembly having a first end adapted to be connected to the boat, and a second end connected to said propulsion unit for causing pivotal movement of said propulsion unit about said steering axis, a valve including a first member fixedly connected to said second and end of said hydraulic assembly, and a second member reciprocally movable relative to said first member, and a link member having a first portion pivotally connected to said elongated member, a second portion pivotally connected to said second member, and a third portion pivotally connected to said first member.

42 Claims, 2 Drawing Sheets

POWER STEERING MECHANISM FOR MARINE INSTALLATIONS

RELATED APPLICATION

This application is a continuation-in-part of U.S. Ferguson Patent Application Ser. No. 028,958, filed Mar. 23, 1987, now U.S. Pat. No. 4,744,777, issued 5/17/88;and assigned to the assignee hereof.

BACKGROUND OF THE INVENTION

The invention relates to marine installations, and, more particularly, to power steering mechanisms for marine installations.

Attention is directed to the following U.S Pat. Nos.:

| | | |
|---|---|---|
| Ferguson | 4,710,141 | Dec. 1, 1987 |
| Hall | 4,615,290 | Oct. 7, 1986 |
| Small | 4,595,370 | Jun. 17, 1986 |
| Ferguson | 4,592,732 | Jun. 3, 1986 |
| Hall | 4,568,292 | Feb. 4, 1986 |
| Ferguson | 4,449,945 | May 22, 1984 |
| Hall | 4,373,920 | Feb. 15, 1983 |
| Borst | 4,295,833 | Oct. 20, 1981 |
| Cox | 4,227,481 | Oct. 14, 1980 |
| Shimanckas | 3,631,833 | Jan. 4, 1972 |
| Simpson | 3,373,642 | Mar. 19, 1968 |
| Hayner | 2,929,362 | Mar. 22, 1960 |
| Ford | 2,928,377 | Mar. 16, 1960 |

SUMMARY OF THE INVENTION

The invention provides a power steering system for a marine propulsion device including mounting means adapted to be mounted on a boat, and a propulsion unit mounted on the mounting means for pivotal movement relative thereto about a generally horizontal tilt axis and about a generally vertical steering axis, the system comprising a tilt tube extending along the tilt axis, an elongated member slideably housed within the tilt tube for axial movement relative thereto, an extendible and contractible hydraulic assembly having a first end adapted to be connected to the boat, and a second end adapted to be connected to the propulsion unit for causing pivotal movement of the propulsion unit about the steering axis, valve means including a first member fixedly connected to the second end of the hydraulic assembly, and a second member reciprocally movable relative to the first member, and a link member having a first portion pivotally connected to the elongated member, a second portion pivotally connected to the second member, and a third portion pivotally connected to the first member.

The invention also provides a power steering system for a marine propulsion device including a propulsion unit adapted to be mounted on the transom of a boat for pivotal movement relative thereto about a generally vertical steering axis, the system comprising a first link extendible and contractible along a first axis and having a first end adapted to be connected to the boat, and a second end adapted to be connected to the propulsion unit for causing pivotal movement of the propulsion unit about the steering axis, control means including a first member connected to the second end of the first link, a second member moveable relative to the first member along a second axis generally parallel to the first axis, and means for causing movement of the second end of the first link in one direction along the first axis in response to movement of the second member in the one direction relative to the first member, and for causing movement of the second end of the first link in the opposite direction in response to movement of the second member in the opposite direction relative to the first member, and a second link extendible and contractible along the second axis and having a first end adapted to be connected to the boat, and a second end connected to the second member.

The invention also provides a power steering system for a marine propulsion device including a propulsion unit adapted to be mounted on the transom of a boat for pivotal movement relative thereto about a generally vertical steering axis, the system comprising a first hydraulic assembly extendible and contractible along a first axis and having a first end adapted to be connected to the boat, and a second end adapted to be connected to the propulsion unit for causing pivotal movement of the propulsion unit about the steering axis, valve means including a first member connected to the second end of the first hydraulic assembly, a second member moveable relative to the first member along a second axis generally parallel to the first axis, and means for causing movement of the second end of the first hydraulic assembly in one direction along the first axis in response to movement of the second member in the one direction relative to the first member, and for causing movement of the second end of the first hydraulic assembly in the opposite direction in response to movement of the second member in the opposite direction relative to the first member, and a second hydraulic assembly extendible and contractible along the second axis and having a first end adapted to be connected to the boat, and a second end connected to the second member.

The invention also provides a power steering system for a marine propulsion device including a propulsion unit adapted to be mounted on the transom of a boat for pivotal movement relative thereto about a generally vertical steering axis, the system comprising a first hydraulic assembly extendible and contractible along a first axis and having a first end adapted to be connected to the boat, and a second end adapted to be connected to the propulsion unit for causing pivotal movement of the propulsion unit about the steering axis, and valve means operatively connected to the first hydraulic assembly and including a valve housing having therein a spool bore, first and second ports communicating with the spool bore, a fluid inlet passageway, and a fluid outlet passageway, and the valve housing being connected to the second end of the hydraulic assembly for common movement of the valve housing with the second end, and the valve means also including a spool slideably housed in the spool bore for movement relative to the valve housing along the second axis, and means operable in a first mode for connecting the inlet passageway to the first port and the outlet passageway to the second port, and operable in a second mode for connecting the inlet passageway to the second port and the outlet passageway to the first port.

The invention also provides a power steering system for a marine propulsion device including a propulsion unit adapted to be mounted on the transom of a boat for pivotal movement relative thereto about a generally vertical steering axis, the system comprising an extendible and contractible first link having a first end adapted to be connected to the boat, and a second end adapted to be connected to the propulsion unit for causing pivotal movement of the propulsion unit about the steering axis, control means including a first member connected to the second end of said first link, a second member moveable relative to the first member, and means for causing movement of the second end of the first link in response to movement of the second member relative to the first member, and an extendible and contractible second link having a first end fixed to the first link, and a second end connected to the second member.

The invention also provides a valve apparatus comprising a valve housing including a spool bore, first and second ports communicating with the spool bore, a fluid inlet passageway, and a fluid outlet passageway, means operable in a first mode for connecting the inlet passageway to the first port and the outlet passageway to the second port, and operable in a second mode for connecting the inlet passageway to the second port and the outlet passageway to the first port, and a valve spool slideably housed in the spool bore.

A principal feature of the invention is the provision of a power steering mechanism for an outboard motor. The power steering mechanism comprises an extendible and contractible first link having a first end adapted to be connected to the boat, and a second end connected to the outboard motor for causing steering movement of the outboard motor. The power steering mechanism also comprises means including a housing connected to the second end of the first link for common movement therewith, a member movable relative to the housing, and means for causing movement of the second end of the first link in response to movement of the member relative to the housing. The power steering mechanism further comprises an extendible and contractible second link having a first end fixed to the first link, and a second end connected to the member for common movement of the member with the second end of the second link. Preferably, the first and second links respectively include first and second cylinders fixed to each other.

Another principal feature of the invention is the provision of a power steering mechanism comprising a hydraulic power steering assembly extending along an axis parallel to the tilt axis of the outboard motor and having a first end connected to the boat, and a second end connected to the outboard motor for causing steering movement of the outboard motor. The power steering mechanism also comprises a spool valve assembly including a valve housing connected to the second end of the power steering assembly for common movement therewith, and a spool movable relative to the valve housing along a second axis parallel to the tilt axis. The power steering mechanism further comprises a hydraulic actuating assembly extending along the second axis and having a first end connected to the boat, and a second end connected to the spool for common movement of the spool therewith.

Another principal feature of the invention is the provision of a power steering mechanism comprising a hydraulic power steering assembly as described above, and valve means including a valve housing having therein a spool bore, first and second ports communicating with the spool bore, a fluid inlet passageway, and a fluid outlet passageway, and means operable in a first mode for connecting the inlet passageway to the first port and the outlet passageway to the second port, and operable in a second mode for connecting the inlet passageway to the second port and the outlet passageway to the first port. This arrangement permits the valve means to be actuated by different actuating means, e.g., by a push/pull cable or by a hydraulic actuating assembly, without requiring hydraulic lines to be rerouted.

Another principal feature of the invention is the provision of a power steering mechanism comprising a tilt tube, an elongated member slideably housed within the tilt tube for axial movement relative thereto, a hydraulic assembly having a first end adapted to be connected to the boat, and a second end connected to the propulsion unit, valve means including a first member fixedly connected to the second end of the hydraulic assembly, and a second member reciprocally movable relative to the first member, and a lever having a first portion pivotally connected to the elongated member, a second portion pivotally connected to the second member, and a third portion pivotally connected to the first member.

Other features and advantages of the invention will become apparent to those skilled in the art upon review of the following detailed description, claims and drawings.

Figure 1:
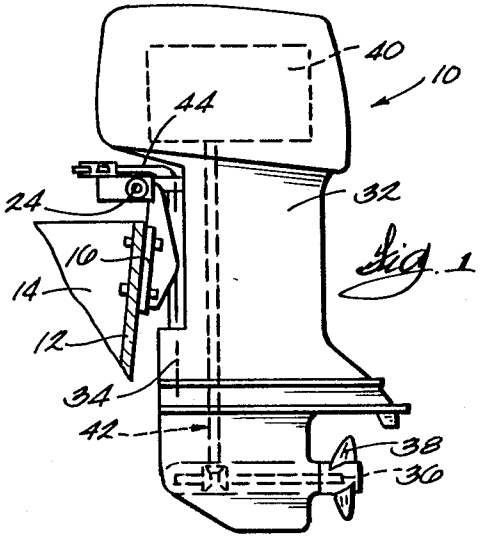
FIG. 1 is a side elevational view of a marine installation which includes a power steering system and which embodies the invention.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

A marine propulsion device 10 embodying the invention is illustrated in the drawings. While the illustrated marine propulsion device 10 is an outboard motor, it should be understood that at least some of the features of the invention are also applicable to stern drive units.

Figure 2:
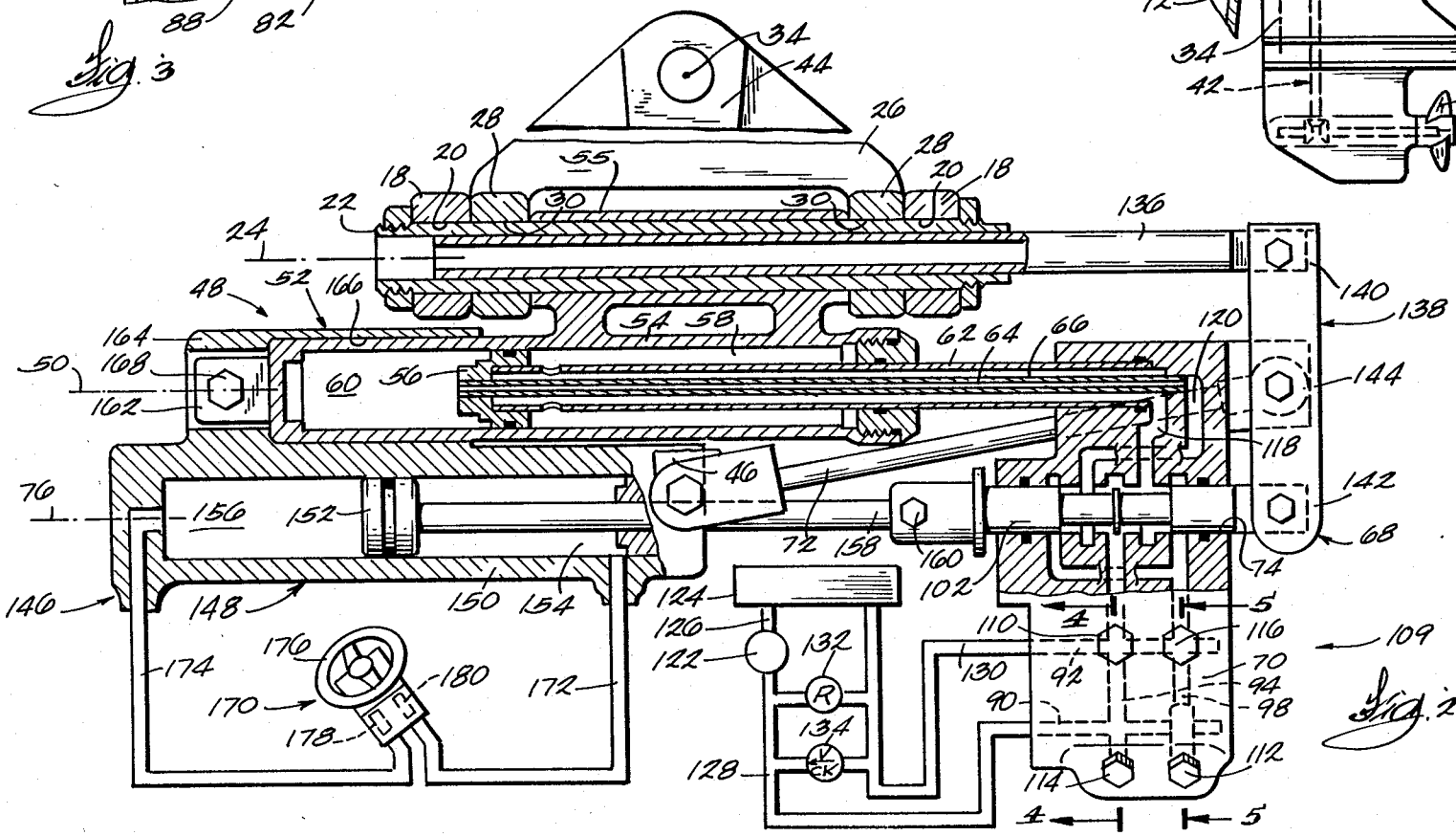
FIG. 2 is an enlarged plan view, partially in section and partially schematic, of the power steering system.

The marine propulsion device 10 comprises mounting means adapted to be mounted on the transom 12 of a boat 14. While various suitable mounting means can be employed, in the preferred embodiment, the mounting means includes a transom bracket 16 mounted on the transom 12 and including (see FIG. 2) a pair of laterally spaced arms 18 having therein respective bores 20. The mounting means also includes a tilt tube 22 housed in the bores 20 and extending along a generally horizontal tilt axis 24, and a swivel bracket 26 mounted on the tilt tube 22 for pivotal movement about the tilt axis 24. More particularly, the swivel bracket 26 includes a pair of laterally spaced lugs 28 located adjacent the arms and including respective bores 30 receiving the tilt tube 22.

The marine propulsion device 10 also comprises (see FIG. 1) a propulsion unit 32 mounted on the swivel bracket 26 for pivotal movement relative thereto about a generally vertical steering axis 34. The propulsion unit 32 includes a propeller shaft 36 rotatably supporting a propeller 38, and an engine 40 drivingly connected to the propeller shaft 36 via a conventional drive train 42. The marine propulsion device 10 also comprises a steering arm 44 fixedly connected to the propulsion unit 32. The steering arm 44 has a forward end 46 (FIG. 2) and causes steering movement of the propulsion unit 32 in response to lateral movement of the forward end 46 of the steering arm 44.

The marine propulsion device 10 also comprises a first link 48 extendible and contractible along a first axis 50 generally parallel to the tilt axis 24. The link 48 has a first or left end connected to the boat 14, and a second or right end connected to the forward end 46 of the steering arm 44 and therefore to the propulsion unit 32 for causing pivotal movement of the propulsion unit 32 about the steering axis 34. While various suitable extendible and contractible links can be used, in the illustrated construction, the link 48 is a hydraulic assembly 52 including a cylinder 54 fixed against axial movement relative to the transom bracket 16. Preferably, the cylinder 54 includes an integral portion 55 extending between the swivel bracket lugs 28 and surrounding the tilt tube 22. The assembly 52 also includes a piston 56 slideably housed in the cylinder 54 and dividing the cylinder into first and second or right and left chambers 58 and 60, respectively, and a piston rod 62 having an inner end fixedly connected to the piston 56 and an outer end connected to the steering arm 44 as described hereinafter. The piston rod 62 extends through the right chamber 58 and has therein an inner passageway 64 communicating with the left chamber 60 and an outer passageway 66 communicating with the right chamber 58.

The marine propulsion device 10 also comprises control or valve means 68 including a first member or valve housing 70 connected to the outer end of the piston rod 62 for common movement therewith. In the preferred embodiment, the valve housing 70 and the piston rod 62 are connected to the forward end 46 of the steering arm 44 by a steering link 72 having one end pivotally connected to the valve housing 70 and an opposite end pivotally connected to the steering arm 44.

The valve housing 70 has therein a spool bore 74 extending along a second axis 76 generally parallel to the first axis 50, and the valve housing 70 also has therein (see FIG. 3) first, second, third, fourth and fifth ports 78, 80, 82, 84 and 86, respectively, communicating with the spool bore 74 and serially spaced from left to right. The first port 78 is connected to the fifth port 86 via a passageway 88. The housing 70 also has therein (see FIGS. 1, 4 and 5) a fluid inlet passageway 90, a fluid outlet passageway 92, a first passageway 94 communicating between the inlet passageway 90 and the third port 82, a second passageway 96 communicating between the outlet passageway 92 and the third port 82, a third passageway 98 communicating between the inlet passageway 90 and the fifth port 86, and a fourth passageway 100 communicating between the outlet passageway 92 and the fifth port 86.

The control or valve means 68 also includes (see FIG. 2) a second member or valve member or spool 102 slideably housed in the spool bore 74 and reciprocally movable relative to the valve housing 70 along the second axis 76. The spool 102 includes first, second and third lands 104, 106 and 108, respectively, and is movable relative to the valve housing 70 between a center position (shown in FIG. 1), a left position (not shown) and a right position (not shown). When the spool 102 is in the center position, the third port 82 communicates with both of the second and fourth ports 80 and 84, the first port 78 communicates with the second port 80, and the fourth port 84 communicates with the fifth port 86. When the spool 102 is in the left position, the first port 78 communicates with the second port 80 and the third port 82 communicates with the fourth port 84. When the spool 102 is in the right position, the second port 80 communicates with the third port 82 and the fourth port 84 communicates with the fifth port 86.

The control or valve means 68 also includes means 109 selectively operable in a first mode for connecting the inlet passageway 90 to the third port 82 and the outlet passageway 92 to the fifth port 86, and selectively and alternatively operable in a second mode for connecting the inlet passageway 90 to the fifth port 86 and the outlet passageway 92 to the third port 82. While various suitable means 109 can be employed, in the preferred embodiment, the means 109 includes a first plug 110 selectively insertable into the first passageway 94 for preventing communication between the inlet passageway 90 and the third port 82, and selectively and alternatively insertable into the second passageway 96 for preventing communication between the outlet passageway 92 and the third port 82. The means 109 also includes a second plug 112 selectively insertable into the third passageway 98 for preventing communicating between the inlet passageway 90 and the fifth port 86, and selectively and alternatively insertable into the fourth passageway 100 for preventing communication between the outlet passageway 92 and the fifth port 86. The means 109 also includes a third plug 114 selectively insertable into the first passageway 94 for closing the end of the first passageway 94 and permitting communication between the inlet passageway 90 and the third port 82, and selectively and alternatively insertable into the second passageway 96 for closing the end of the second passageway 96 and permitting communication between the outlet passageway 92 and the third port 82. The means 109 further includes a fourth plug 116 selectively insertable into the third passageway 98 for closing the end of the third passageway 98 and permitting communication between the inlet passageway 90 and the fifth port 86, and selectively and alternatively insertable into the fourth passageway 100 for closing the end of the fourth passageway 100 and permitting communication between the outlet passageway 92 and the fifth port 86.

Figure 3:
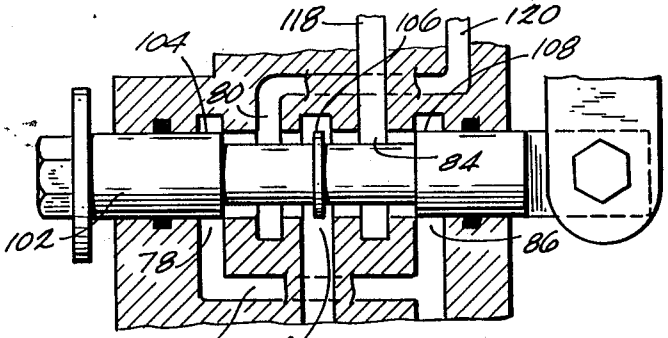
FIG. 3 is an enlarged, partial view of the power steering system.
Figures 4, 5, 6:
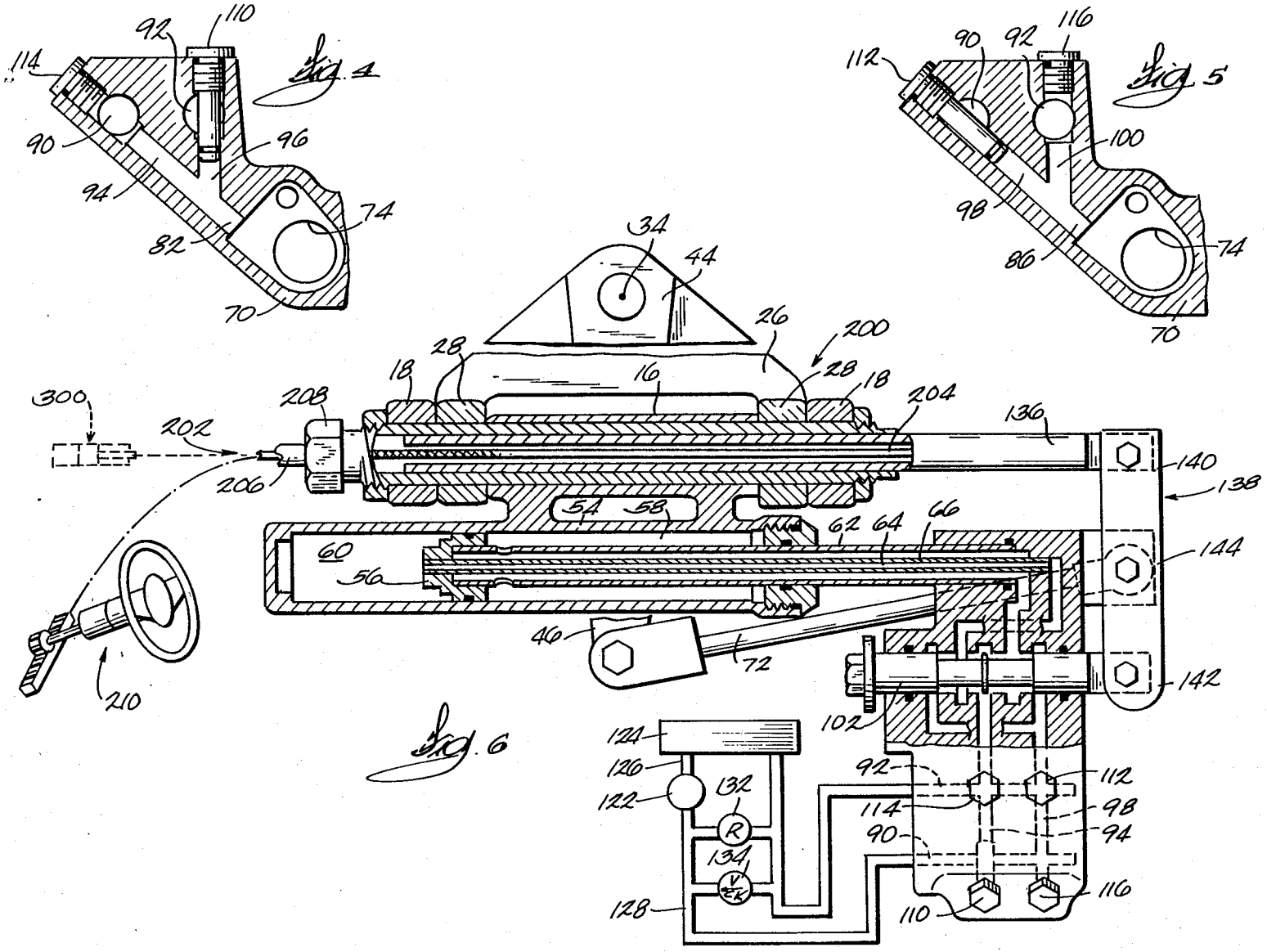
FIG. 4 is a view taken along line 4—4 in FIG. 3.
FIG. 5 is a view taken along line 5—5 in FIG. 3.
FIG. 6 is a view similar to FIG. 2 and showing an alternative embodiment of the invention.

The plugs 110, 112, 114 and 116 are illustrated in FIGS. 3–5. In the preferred embodiment, the first plug 110 is inserted into the second passageway 96, the second plug 112 is inserted into the third passageway 98, the third plug 114 is inserted into the first passageway 94 and the fourth plug 116 is inserted into the fourth passageway 100. Therefore, the inlet passageway 90 communicates with the third port 82, and the outlet passageway 92 communicates with the fifth port 86.

The control or valve means 68 also includes means for causing movement of the piston rod 62 in one direction (to the right in FIG. 1) along the first axis 50 in response to movement of the spool 102 to the right relative to the valve housing 70, and for causing movement of the piston rod 62 in the opposite direction (to the left in FIG. 1) in response to movement of the spool 102 to the left relative to the valve housing 70. While various suitable means can be employed, in the preferred embodiment, such means includes (see FIGS. 2 and 3) a passageway 118 connecting the fourth port 84 to the outer passageway 66 in the piston rod 62 and thus to the first or right chamber 58, and a passageway 120 connecting the second port 80 to the inner passageway 64 in the piston rod 62 and thus to the second or left chamber 60. The means for moving the piston rod 62 also includes means for supplying pressurized fluid to the inlet passageway 90. While various suitable means can be used, in the preferred embodiment, such means includes a pump 122 (shown schematically) driven by the engine 40 or by another suitable power source, such as an electric motor. The pump 122 is connected to a sump or reservoir 124 by a conduit 126 and to the fluid inlet passageway 90 by a supply conduit 128. The outlet passageway 92 is connected to the sump 124 by a return conduit 130. A relief valve 132 communicates between the supply conduit 128 and the return conduit 130, and a check valve 134 communicates between the supply conduit 128 and the return conduit 130.

Accordingly, in the preferred embodiment, when the spool 102 is in the center position, the fluid inlet passageway 90 communicates with both of the cylinder chambers 58 and 60 so that chambers 58 and 60 are equally pressurized. When the spool 102 is in the left position, the fluid inlet passageway 90 communicates with the first or right chamber 58, and this causes the piston 56, the piston rod 62 and the valve housing 70 to move to the left. When the spool 102 is in the right position, the fluid inlet passageway 90 communicates with the second or left chamber 60, and this causes the piston 56, the piston rod 62 and the valve housing 70 to move to the right.

The marine propulsion device 10 also comprises (see FIG. 1) an elongated member or guide rod or guide tube 136 slideably housed in the tilt tube 22 for axial movement relative thereto, and a lever or link member 138 having a first end or portion 140 pivotally connected to the right end of the rod 136, a second end or portion 142 pivotally connected to the right end of the spool 102, and a third portion 144 which is located intermediate the first and second ends 140 and 142 and which is pivotally connected to the valve housing 70.

The hydraulic assembly 52 can be actuated, i.e., the spool 102 can be moved relative to the valve housing 70, either by applying an axial force directly to the spool 102, or by moving the guide rod 136 axially, which movement rotates the lever 138 relative to the valve housing 70 and thereby moves the spool 102 relative to the valve housing 70. In the preferred embodiment, the marine propulsion device 10 comprises means operable independently of the lever 138 for moving the spool 102 relative to the valve housing 70, i.e., for applying an axial force directly to the spool 102. In the preferred embodiment, this means includes a second link 146 extendible and contractible along the second axis 76 and having a first or left end connected to the boat 14, and a second or right end connected to the spool 102 for common movement of the spool 102 with the right end of the link 146. While various suitable links can be used, in the illustrated construction, the second link 146 is a hydraulic assembly 148 including a cylinder 150 fixedly connected to the cylinder 54 and thus to the boat 14. More particularly, the left end of the cylinder 54 has thereon an ear 162, the cylinder 150 includes a projecting portion 164 having therein a recess 166 which houses the ear 162 and the left end of the cylinder 54, and the projecting portion 164 is connected to the cylinder 54 by a bolt 168 extending through the projecting portion 164 and through the ear 162. The hydraulic assembly 148 also includes a piston 152 slideably housed in the cylinder 150 and dividing the cylinder 150 into first and second or right and left chambers 154 and 156, respectively, and a piston rod 158 having an inner end fixedly connected to the piston 152 and an outer end connected to the spool 102 by a bolt 160. In the preferred embodiment, the guide rod 136 and the lever 138 prevent rotation of the valve housing 70 relative to the cylinder 150. This prevents side loading of the cylinder 150.

The cylinders 54 and 150 constitute a cylinder housing having therein a first bore housing the piston 56 and a second bore housing the piston 152. In alternative embodiments, the cylinders 54 and 150 can be integrally connected.

The marine propulsion device 10 also comprises operator actuatable means for extending and contracting the hydraulic assembly 148. While various suitable means can be employed, in the preferred embodiment, such means includes operator actuated steering means 170 communicating with the cylinder chambers 154 and 156 via fluid lines 172 and 174, respectively, and including a steering wheel 176, a fluid reservior 178 and a pump 180. The pump 180 supplies fluid to the line 174 in response to rotation of the steering wheel 176 in one direction, and supplies fluid to the line 172 in response to rotation of the steering wheel 176 in the opposite direction. Such an arrangement is known in the art and need not be described in greater detail.

The marine propulsion device 10 operates as follows. When the steering wheel 176 is turned in one direction, the pump 180 supplies fluid to the chamber 156, and this causes the piston rod 158 to move to the right. Movement of the piston rod 158 to the right moves the spool 102 to the right relative to the valve housing 70, and this causes the piston rod 62 and the valve housing 70 to move to the right, as described above. Movement of the valve housing 70 to the right recenters the spool 102 relative to the valve housing 70, and this stops movement of the piston rod 62 until the steering wheel 176 is moved again. When the steering wheel 176 is turned in the other direction, the pump 180 supplies fluid to the chamber 154, and this causes movement of the piston rod 158 to the left. Movement of the piston rod 158 to the left causes movement of the spool 102 to the left relative to the valve housing 70, and this causes the piston rod 62 and the valve housing 70 to move to the left, as described above. Movement of the valve housing 70 to the left recenters the spool 102, and this stops movement of the piston rod 62 until the steering wheel 176 is moved again.

It should be understood that in alternative embodiments the valve housing 70 can be connected to the piston rod 158 and the spool 102 can be connected to the piston rod 62.

A marine propulsion device 200 which is an alternative embodiment of the invention is illustrated in FIG. 6. Except as explained hereinafter, the marine propulsion device 200 is substantially identical to the marine propulsion device 10 of the preferred embodiment, and common elements have been given the same reference numerals.

In the alternative embodiment, the marine propulsion device 200 comprises means for moving the guide tube 136 axially of the tilt tube 22. Therefore, the guide tube 136 acts as a steering ram, as described in parent application Ser. No. 028,958, which was filed Mar. 23, 1987 and which is hereby incorporated by reference. While various suitable means can be used for moving the guide tube 136, in the illustrated construction, such means includes a push/pull cable 202 having an inner core 204 fixedly connected to the guide tube 136 for common movement therewith, and an outer sheath 206 fixedly connected to the tilt tube 22 by a member 208 threaded onto the left end of the tilt tube 22. The means also includes a conventional steering device 210 for causing movement of the inner core 204 relative to the outer sheath 206. Such a device is known in the art and need not be described in greater detail.

Because, in the alternative embodiment, the spool 102 is actuated by the lever 138 rather than by a hydraulic assembly, the hydraulic assembly 52 causes movement of the valve housing 70 in the direction opposite the direction of movement of the spool 102. The reason for this is explained in the parent application. In order to have the valve housing 70 move in the direction opposite the direction of spool movement, the first plug 110 is inserted in the first passageway 94, the second plug 112 is inserted in the fourth passageway 100, the third plug 114 is inserted in the second passageway 96, and the fourth plug 116 is inserted in the third passageway 98. Accordingly, when the spool 102 is in the left position, the fluid inlet passageway 90 communicates with the second or left chamber 60, and the fluid outlet passageway 92 communicates with the first or right chamber 58. When the spool 102 is in the right position, the fluid inlet passageway 90 communicates with the first or right chamber 58, and the fluid outlet passageway 92 communicates with the second or left chamber 60.

Operation of the marine propulsion device 200 is substantially identical to operation of the marine propulsion device disclosed in the parent application.

In a second alternative embodiment, the means for moving the guide tube 136 axially of the tilt tube 22 includes, instead of the cable 202, a hydraulic assembly 300 (shown in dotted lines in FIG. 6) extendible and contractible along the tilt axis 24 and having one end connected to the boat 14 or the transom bracket 16, and an opposite end connected to the guide tube 136 for common movement therewith. Any suitable means, such as the steering means 170 of the preferred embodiment, can be used to actuate the hydraulic assembly 300.

Various features of the invention are set forth in the following claims.

I claim:

1. A marine propulsion device comprising mounting means adapted to be mounted on a boat and including a tilt tube extending along a generally horizontal tilt axis, a propulsion unit mounted on said mounting means for pivotal movement relative thereto about said tilt axis and about a generally vertical steering axis, said propulsion unit including a propeller shaft adapted to rotatably support a propeller, an elongated member slideably housed within said tilt tube for axial movement relative thereto, an extendible and contractible hydraulic assembly having a first end adapted to be connected to the boat, and a second end connected to said propulsion unit for causing pivotal movement of said propulsion unit about said steering axis, valve means including a first member fixedly connected to said second end of said hydraulic assembly, and a second member reciprocally movable relative to said first member, and a link member having a first portion pivotally connected to said elongated member, a second portion pivotally connected to said second member, and a third portion pivotally connected to said first member.

2. A device as set forth in claim 1 wherein said hydraulic assembly is extendible and contractible along an axis generally parallel to said tilt axis, and wherein said second member is reciprocally movable relative to said first member along an axis generally parallel to said tilt axis.

3. A marine propulsion device comprising a propulsion unit adapted to be mounted on the transom of a boat for pivotal movement relative thereto about a generally vertical steering axis, said propulsion unit including a propeller shaft adapted to rotatably support a propeller, a first link extendible and contractible along a first axis and having a first end adapted to be connected to the boat, and a second end connected to said propulsion unit for causing pivotal movement of said propulsion unit about said steering axis, control means including a first member connected to said second end of said first link, a second member moveable relative to said first member along a second axis generally parallel to said first axis, and means for causing movement of said second end of said first link in one direction along said first axis in response to movement of said second member in said one direction relative to said first member, and for causing movement of said second end of said first link in the opposite direction in response to movement of said second member in said opposite direction relative to said first member, and a second link extendible and contractible along said second axis and having a first end adapted to be connected to the boat, and a second end connected to said second member.

4. A device as set forth in claim 3 wherein said propulsion unit is adapted to be mounted on the boat for pivotal movement relative thereto about a generally horizontal tilt axis which is generally parallel to said first and second axes, and wherein said assembly further comprises a rod adapted to be mounted on the boat for axial movement along said tilt axis, and a lever having a first portion pivotally connected to said rod, a second portion pivotally connected to said second member, and a third portion pivotally connected to said first member.

5. A device as set forth in claim 4 and further comprising a tilt tube extending along said tilt axis and slideably housing said rod.

6. A device as set forth in claim 3 wherein said propulsion unit further comprises a steering arm, and wherein said first member is connected to said steering arm by a steering link having one end pivotally connected to said first member and an opposite end pivotally connected to said steering arm.

7. A marine propulsion device comprising a propulsion unit adapted to be mounted on the transom of a boat for pivotal movement relative thereto about a generallY vertical steering axis, said propulsion unit including a propeller shaft adapted to rotatably support a propeller, a first hydraulic assembly extendible and contractible along a first axis and having a first end adapted to be connected to the boat, and a second end connected to said propulsion unit for causing pivotal movement of said propulsion unit about said steering axis, valve means including a first member connected to said second end of said first hydraulic assembly, a second member moveable relative to said first member along a second axis generally parallel to said first axis, and means for causing movement of said second end of said first hydraulic assembly in one direction along said first axis in response to movement of said second member in said one direction relative to said first member, and for causing movement of said second end of said first hydraulic assembly in the opposite direction in response to movement of said second member in said opposite direction relative to said first member, and a second hydraulic assembly extendible and contractible along said second axis and having a first end adapted to be connected to the boat, and a second end connected to said second member.

8. A device as set forth in claim 7 wherein said first hydraulic assembly includes a cylinder adapted to be connected to one of said first member and the boat, and a piston rod adapted to be connected to the other of said first member and the boat.

9. A device as set forth in claim 8 wherein said first hydraulic assembly further includes a piston fixedly connected to said piston rod and dividing said cylinder into first and second chambers, wherein said piston rod extends through said first chamber, wherein movement of said piston rod in said one direction increases the volume of said second chamber, wherein said first member has therein a fluid inlet passageway, and wherein said valve means also includes means for connecting said inlet passageway to said second chamber in response to movement of said second member in said one direction relative to said first member, and for connecting said inlet passageway to said first chamber in response to movement of said second member in said opposite direction relative to said first member.

10. A device as set forth in claim 9 wherein said piston rod is connected to said first member and has therein an inner passageway communicating with said second chamber and an outer passageway communicating with said first chamber.

11. A device as set forth in claim 7 wherein said propulsion unit is adapted to be mounted on the boat for pivotal movement relative thereto about a generally horizontal tilt axis which is generally parallel to said first and second axes, wherein said assembly further comprises a guide rod adapted to be mounted on the boat for axial movement along said tilt axis, and a lever having a first end pivotally connected to said guide rod, and a second end pivotally connected to said second member, and wherein said lever is pivotally connected to said first member at a point intermediate said first and second ends of said lever.

12. A device as set forth in claim 7 wherein said assembly further comprises a steering arm, and wherein said first member is connected to said steering arm by a steering link having one end pivotally connected to said first member and an opposite en pivotally connected to said steering arm.

13. A marine propulsion device comprising a propulsion unit adapted to be mounted on the transom of a boat for pivotal movement relative thereto about a generally vertical steering axis, said propulsion unit including a propeller shaft adapted to rotatably support a propeller, a first hydraulic assembly extendible and contractible along a first axis and having a first end adapted to be connected to the boat, and a second end connected to said propulsion unit for causing pivotal movement of said propulsion unit about said steering axis, and valve means operatively connected to said first hydraulic assembly and including a valve housing having therein a spool bore, first and second ports communicating with said spool bore, a fluid inlet passageway, and a fluid outlet passageway, and said valve housing being connected to said second end of said hydraulic assembly for common movement of said valve housing with said second end, and said valve means also including a spool slideably housed in said spool bore for movement relative to said valve housing along said second axis, and means operable in a first mode for connecting said inlet passageway to said first port and said outlet passageway to said second port, and operable in a second mode for connecting said inlet passageway to said second port and said outlet passageway to said first port.

14. A device as set forth in claim 13 and further comprising a lever having a first end, and a second end pivotally connected to said spool, said lever being pivotally mounted on said valve housing at a point intermediate said first and second ends of said lever.

15. A device as set forth in claim 14 wherein said propulsion unit is adapted to be mounted on the boat for pivotal movement relative thereto about a generally horizontal tilt axis, and wherein said assembly further comprises a guide rod adapted to be mounted on the boat for axial movement along said tilt axis, and wherein said first end of said lever is pivotally connected to said guide rod.

16. A device as set forth in claim 13 wherein said valve means also includes means for causing movement of said second end of said first hydraulic assembly in one direction along said first axis in response to movement of said spool in said one direction relative to said valve housing, and for causing movement of said second end of said first hydraulic assembly in the opposite direction in response to movement of said spool in said opposite direction relative to said valve housing.

17. A device as set forth in claim 13 and further comprising a second hydraulic assembly extendible and contractible along a second axis generally parallel to said first axis, said second assembly having a first end adapted to be connected to the boat, and a second end connected to said spool.

18. A device as set forth in claim 13 wherein said first hydraulic assembly includes a cylinder adapted to be connected to one of said valve housing and the boat, and a piston rod adapted to be connected to the other of said valve housing and the boat.

19. A device as set forth in claim 18 wherein said first hydraulic assembly further includes a piston fixedly connected to said piston rod and dividing said cylinder into first and second chambers, and wherein said valve means also includes means for connecting said first port to said first chamber in response to movement of said spool in one direction relative to said valve housing, and for connecting said first port to said second in response to movement of said spool in the opposite direction relative to said valve housing.

20. A device as set forth in claim 19 wherein said piston rod is connected to said valve housing and has therein an inner passageway communicating with said second chamber and an outer passageway communicating with said first chamber.

21. A device as set forth in claim 13 wherein said propulsion unit includes a steering arm, and wherein said assembly further comprises a steering link having one end pivotally connected to said valve housing and an opposite end pivotally connected to said steering arm.

22. A device as set forth in claim 13 wherein said valve housing also includes a first passageway communicating between said inlet passageway and said first port, a second passageway communicating between said outlet passageway and said first port, a third passageway communicating between said inlet passageway and said second port, and a forth passageway communicating between said outlet passageway and said second port, and wherein said connecting means includes a first plug selectively and alternatively insertable into said first passageway for preventing communication between said inlet passageway and said first port, and insertable into said second passageway for preventing communication between said outlet passageway and said first port, and a second plug selectively and alternatively insertable into said third passageway for preventing communication between said inlet passageway and said second port, and insertable into said forth passageway for preventing communication between said outlet passageway and said second port.

23. A device as set forth in claim 22 wherein said first plug is inserted into said second passageway and said second plug is inserted into said third passageway when said connecting means is operating in said first mode, and wherein said first plug is inserted into said first passageway and said second plug is inserted into said fourth passageway when said connecting means is operating in said second mode.

24. A device as set forth in claim 13 and further comprising a lever having a first portion, a second portion pivotally connected to said spool, and a third portion pivotally connected to said valve housing.

25. A valve apparatus comprising a valve housing including a spool bore, said valve housing also including first and second ports communicating directly with said spool bore, said valve housing also including a fluid outlet passageway communicating directly with said spool bore, and said valve housing also including a fluid outlet passageway communicating directing with said spool bore, and a valve spool slideably housed in said spool bore and including means operable in a first mode for connecting said inlet passageway to said first port and said outlet passageway to said second port, and operable in a second mode for connecting said inlet passageway to said second port and said outlet passageway to said first port.

26. A valve apparatus comprising a valve housing including a spool bore, first and second ports communicating with said spool bore, a fluid inlet passageway communicating with said spool bore, and a fluid outlet passageway communicating with said spool bore, a first passageway commuicating between said inlet passageway and said first port, a second passageway communicating between said outlet passageway and said first port, a third passageway communicating between said inlet passageway and said second port, and a fourth passageway communicating between said outlet passageway and said second pot, and a valve spool slideably housed in said spool bore and including means operable in a first mode for connecting said inlet passageway to said first port and said outlet passageway to said second port, and operable in a second mode for connecting said inlet passageway to said second port and said outlet passageway to said first port said connecting means including a first plut selectively and alternatively insertable into said first plug selectively preventing communication between said inlet passageway and said first port, and insertable into said second passageway for preventing communication between said outlet passageway and said first port, and a second plug selectively and alternatively insetable into said third passageway for preventing communication between said inlet passageway and said second port, and insertable inot said fourth passageway for preventing communication between said outlet passageway and said second port.

27. A valve apparatus as set forth in claim 26 wherein said first plug is inserted into said second passageway and said second plug is inserted into said third passageway when said connecting means is operating in said first mode, and wherein said first plug is inserted into said first passageway and said second plug is inserted into said fourth passageway when said connecting means is operating in said second mode.

28. A valve apparatus comprising a valve housing including a spool bore, first and second ports communicating with said spool bore, a fluid inlet passageway communicating with said spool bore, and a fluid outlet passageway communicating with said spool bore, a lever having a first end, a second end, and being pivotally mounted on said valve housing at a point intermediate said first and second ends, and a valve spool slideably housed in said spool bore, pivotally connected to said second end of said lever, including means operable in a first mode for connecting said inlet passageway to said first port and said outlet passageway to said second port, and operable in a second mode for connecting said inlet passageway to said second port and said outlet passageway to said first port, and being adapted to be connected to means operable independently of said lever for moving said spool relative to said valve housing.

29. A power steering system for a marine propulsion device including mounting means adapted to be mounted on a boat, and a propulsion unit mounted on the mounting means for pivotal movement relative thereto about a generally horizontal tilt axis and about a generally vertical steering axis, said system comprising a tilt tube extending along said tilt axis, an elongated member slideably housed within said tilt tube for axial movement relative thereto, an extendible and contractible hydraulic assembly having a first end adapted to be connected to the boat, and a second end adapted to be connected to the propulsion unit for causing pivotal movement of the propulsion unit about the steering axis, valve means including a first member fixedly connected to said second end of said hydraulic assembly, and a second member reciprocally movable relative to said first member, and a link member having a first portion pivotally connected to said elongated member, a second portion pivotally connected to said second member, and a third portion pivotally connected to said first member.

30. A power steering system for a marine propulsion device including a propulsion unit adapted to be mounted on the transom of a boat for pivotal movement relative thereto about a generally vertical steering axis, said system comprising a first link extendible and contractible along a first axis and having a first end adapted to be connected to the boat, and a second end adapted to be connected to the propulsion unit for causing pivotal movement of the propulsion unit about the steering axis, control means including a first member connected to said second end of said first link, a second member moveable relative to said first member along a second axis generally parallel to said first axis, and means for causing movement of said second end of said first link in one direction along said first axis in response to movement of said second member in said one direction relative to said first member, and for causing movement of said second end of said first link in the opposite direction in response to movement of said second member in said opposite direction relative to said first member, and a second link extendible and contractible along said second axis and having a first end adapted to be connected to the boat, and a second end connected to said second member.

31. A power steering system for a marine propulsion device including a propulsion unit adapted to be mounted on the transom of a boat for pivotal movement relative thereto about a generally vertical steering axis, said system comprising a first hydraulic assembly extendible and contractible along a first axis and having a first end adapted to be connected to the boat, and a second end adapted to be connected to the propulsion unit for causing pivotal movement of the propulsion unit about the steering axis, valve means including a first member connected to said second end of said first hydraulic assembly, a second member moveable relative to said first member along a second axis generally parallel to said first axis, and means for causing movement of said second end of said first hydraulic assembly in one direction along said first axis in response to movement of said second member in said one direction relative to said first member, and for causing movement of said second end of said first hydraulic assembly in the opposite direction in response to movement of said second member in said opposite direction relative to said first member, and a second hydraulic assembly extendible and contractible along said second axis and having a first end adapted to be connected to the boat, and a second end connected to said second member.

32. A power steering system for a marine propulsion device including a propulsion unit adapted to be mounted on the transom of a boat for pivotal movement relative thereto about a generally vertical steering axis, said system comprising a first hydraulic assembly extendible and contractible along a first axis and having a first end adapted to be connected to the boat, and a second end adapted to be connected to the propulsion unit for causing pivotal movement of the propulsion unit about the steering axis, and valve means operatively connected to said first hydraulic assembly and including a valve housing having therein a spool bore, first and second ports communicating with said spool bore, a fluid inlet passageway, and a fluid outlet passageway, and said valve housing being connected to said second end of said hydraulic assembly for common movement of said valve housing with said second end, and said valve means also including a spool slideably housed in said spool bore for movement relative to said valve housing along said second axis, and means operable in a first mode for connecting said inlet passageway to said first port and said outlet passageway to said second port, and operable in a second mode for connecting said inlet passageway to said second port and said outlet passageway to said first port.

33. A marine propulsion device comprising a propulsion unit adapted to be mounted on the transom of a boat for pivotal movement relative thereto about a generally vertical steering axis, said propulsion unit including a propeller shaft adapted to rotatably support a propeller, an extendible and contractible first link having a first end adapted to be connected to the boat, and a second end connected to said propulsion unit for causing pivotal movement of said propulsion unit about said steering axis, control means including a first member connected to said second end of said first link, a second member moveable relative to said first member, and means for causing movement of said second end of said first link in response to movement of said second member relative to said first member, and an extendible and contractible second link having a first end fixed to said first link, and a second end connected to said second member.

34. A marine propulsion device as set forth in claim 33 wherein said first end of said second link is fixed to said first end of said first link.

35. A marine propulsion device as set forth in claim 33 wherein said first link includes a first hydraulic assembly, wherein said second link includes a second hydraulic assembly, and wherein said control means includes valve means.

36. A marine propulsion device as set forth in claim 35 wherein said first hydraulic assembly includes a first cylinder adapted to be connected to the boat, a first piston slideably housed in said first cylinder, and a first piston rod having one end fixedly connected to said first piston and an opposite end connected to said propulsion unit, and wherein said second hydraulic assembly includes a second cylinder fixed to said first cylinder, a second piston slideably housed in said second cylinder, and a second piston rod having one end fixed to said second piston and an opposite end connected to said second member.

37. A marine propulsion device as set forth in claim 36 wherein said first and second cylinders are defined by a cylinder housing having therein a first bore slideably housing said first piston and a second bore slideably housing said second piston.

38. A power steering system for a marine propulsion device including a propulsion unit adapted to be mounted on the transom of a boat for pivotal movement relative thereto about a generally vertical steering axis, said system comprising an extendible and contractible first link having a first end adapted to be connected to the boat, and a second end adapted to be connected to the propulsion unit for causing pivotal movement of the propulsion unit about the steering axis, control means including a first member connected to said second end of said first link, a second member moveable relative to said first member, and means for causing movement of said second end of said first link in response to movement of said second member relative to said first member, and an extendible and contractible second link having a first end fixed to said first link, and a second end connected to said second member.

39. A system as set forth in claim 38 wherein said first end of said second link is fixed to said first end of said first link.

40. A system as set forth in claim 38 wherein said first link includes a first hydraulic assembly, wherein said second link includes a second hydraulic assembly, and wherein said control means includes valve means.

41. A system as set forth in claim 40 wherein said first hydraulic assembly includes a first cylinder adapted to be connected to the boat, a first piston slideably housed in said first cylinder, and a first piston rod having one end fixedly connected to said first piston and an opposite end connected to said propulsion unit, and wherein said second hydraulic assembly includes a second cylinder fixed to said first cylinder, a second piston slideably housed in said second cylinder, and a second piston rod having one end fixed to said second piston and an opposite end connected to said second member.

42. A system as set forth in claim 41 wherein said first and second cylinders are defined by a cylinder housing having therein a first bore slideably housing said first piston and a second bore slideably housing said second piston.

* * * * *